US008603387B2

(12) United States Patent
Holzgruber et al.

(10) Patent No.: US 8,603,387 B2
(45) Date of Patent: Dec. 10, 2013

(54) WATER-COOLED COVER FOR A TREATMENT VESSEL FOR METAL MELTS

(75) Inventors: Harald Holzgruber, Bruck a. d. Mur (AT); Michael Luven, Kempen (DE); Christian Buchmaier, Krieglach (AT); Johannes Obitz, Kerken (DE)

(73) Assignee: Inteco Special Melting Technologies GmbH, Bruck A.D. Mur (AT)

( * ) Notice: Subject to any disclaimer, the term of this patent is extended or adjusted under 35 U.S.C. 154(b) by 271 days.

(21) Appl. No.: 13/084,274

(22) Filed: Apr. 11, 2011

(65) Prior Publication Data

US 2011/0260378 A1 Oct. 27, 2011

(30) Foreign Application Priority Data

Apr. 21, 2010 (AT) ..... A 641/2010

(51) Int. Cl.
*C21C 5/46* (2006.01)
*C21C 7/00* (2006.01)

(52) U.S. Cl.
USPC ..... 266/241; 266/276; 373/74

(58) Field of Classification Search
USPC ..... 266/241, 276; 373/74
See application file for complete search history.

(56) References Cited

U.S. PATENT DOCUMENTS 4,552,587 A * 11/1985 Nakashima et al. ..... 75/10.45
6,084,902 A 7/2000 Hawk

FOREIGN PATENT DOCUMENTS

DE 19747317 A 4/1999
JP 10170165 6/1998
JP 2006214647 6/2002

* cited by examiner

*Primary Examiner* — Scott Kastler
(74) *Attorney, Agent, or Firm* — Lucas & Mercanti, LLP; Klaus P. Stoffel

(57) ABSTRACT

A water-cooled cover for a treatment vessel for metal melts, wherein the preferably refractorily lined treatment vessel serves in particular for the treatment of liquid metal, in particular of steel, by blowing in solids or gases, or inductive stirring at atmosphere or in vacuum. The cover is formed dome-like, wherein the ratio of inner clear height (h) to inner clear diameter (D) of a flange of the cover is at least 0.2. On the side facing the metal melt, an inner wall of the cover is formed substantially smooth and free of grooves and gaps. Cooling channels arranged on the outer side of the inner wall so that the surface temperature of the inner wall is maintained at a temperature of maximum 350° C.

4 Claims, 2 Drawing Sheets

WATER-COOLED COVER FOR A TREATMENT VESSEL FOR METAL MELTS

CROSS-REFERENCE TO RELATED APPLICATIONS

The present application claims priority of AT A 641/2010, filed Apr. 21, 2010, and incorporates the same by reference.

BACKGROUND OF THE INVENTION

During the treatment of metal or steel melts in treatment refractorily lined vessels such as, for example transport or, casting ladles, violent reactions between the metal and the slag or blown-in inert or reaction gases can occur or can be caused which can cause a major ejection of metal and slag across the rim of the treatment vessel. During a treatment of the metal or the slag in open air as well as in a closed treatment vessel which can be under vacuum, such ejection occurrences are undesired because, apart from the massive contamination of the environment of the treatment vessel and the treatment vessel itself, an uncontrollable loss of metal and slag is involved.

For these reasons, for such treatment steps of metal or slag, covers for covering the treatment vessel are used which often are simple, uncooled and consist at least partially of ceramic materials in the form of a coating and the behavior of which, however, is dissatisfying because the ceramic materials of the cover react with the slag or the metal and thereby, on the one hand, their durability is reduced and, on the other, they chip off to some extent so that by such ceramic parts, the composition of the slag and the metal can be negatively influenced.

On the other hand, also known are water-cooled cover constructions which in most cases consist of steel tubes or boiler tubes which are arranged on top of each other and are welded together and which, due to their structure, have a number of grooves. In these grooves, metal and slag splashes can get caught and form a basis for the possibility that further splashes can accumulate and stick thereon so that in the extreme case, despite water-cooling the tubes, a dome of sticking and partially welded metal and slag splashes is built up which, during a longer lasting treatment of a steel melt with a weight of, for example, 50 t-80 t, can easily reach a weight of several tons. Depending on the formation of said dome it can happen that the cover can be removed only with difficulties or that parts of the dome break again and fall into the melt and again cause undesired reactions and a disturbance of the temperature balance therein.

It can also happen that the dome of metal and slag splashes sticking on the cover is lifted off together with the latter and falls off in an uncontrolled manner during the transport or at a later time which, besides other inconveniences, represents a significant hazard.

However, in this case, residues of metal and slag splashes adhering on the cover have to be removed prior to the next use because if such residues fall down at a next melt, the same can be contaminated in an unacceptable manner.

In some cases it has happened that the dome consisting of metal and slag splashes remained on the treatment vessel after removing the cover and thereby has interfered with the further treatment of the melt because said treatment could only be continued after the removal of the dome. Even if there are no other problems, this, depending on the duration of the work, has a negative effect on the temperature course within the treatment vessel and thus is undesired or even unacceptable if no possibility for reheating the treatment vessel or the mass to be treated is available.

SUMMARY OF THE INVENTION

Therefore, based on the above-described prior art, it is the object of the invention to provide a water-cooled cover for covering metal and slag in a treatment vessel in such a manner that the aforementioned problems do not occur at all or only to a small and tolerable extent.

This cover structured according to the invention involves a water-cooled cover for a treatment vessel which is in particular lined in a refractory manner, which also can be a transport or casting ladle, for the treatment of liquid metal, in particular steel, by blowing in inert or reactive gases, with or without loading solids, with or without inductive stirring or heating the melt in the treatment vessel at the surrounding atmosphere or under vacuum, with the following features:

- The shape of the cover is formed dome-like, wherein the ratio of clear height of the cover to clear diameter of the base flange of the cover is at least 0.20.
- The inner surface of the cover facing the molten bath is smooth and substantially free of grooves and gaps.
- By cooling channels which are attached on the outside of the cover and through which cooling water flows, the surface temperature of the inner surface of the cover facing the molten bath can be maintained below 350° C.

All combinations of at least two features disclosed in the claims, the description and/or figures come into the scope of the invention.

In order to be able to introduce a blowing lance into or above the melt contained in the treatment vessel, the cover can have a central opening.

The cover itself can consist of sheet steel, for example in the form of a dished end or a welded sheet metal construction. In this case, the cover has preferably a wall thickness of 3 mm to 10 mm and the cooling channels are welded on the cover in required quantity and arrangement.

There is also the possibility to attach on the inside of the cover consisting of sheet steel one or more additional cooling elements made of a material with a higher thermal conductivity than steel such as, for example, copper and thus to additionally hinder or prevent the formation of a metal-slag dome.

However, it is also possible for the above described cover to use copper sheet onto which the cooling channels are preferably soldered in the form of tubes.

It is principally also possible to completely or partially plate the inner wall of the cover made of steel sheet with copper or another material with a higher thermal conductivity than steel with a layer thickness of 2 mm to 6 mm.

Further advantages, features and details of the invention arise from the following description of a particularly preferred exemplary embodiment and the drawing.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
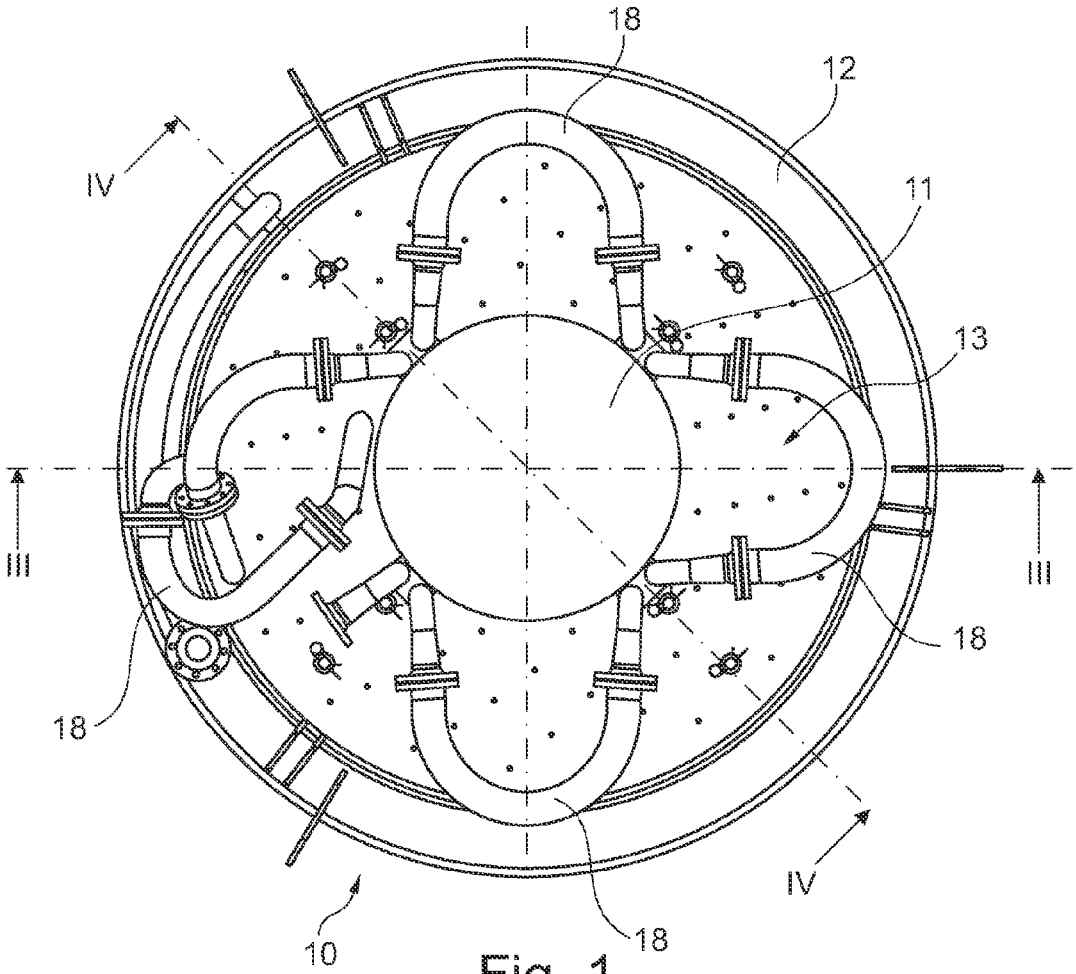
FIG. 1 shows a cover according to the invention in a top view.
Figure 2:
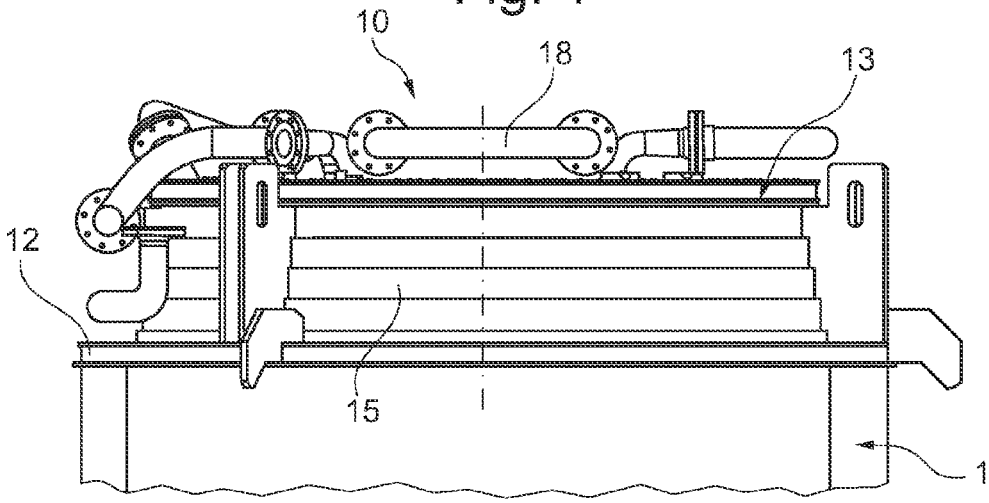
FIG. 2 shows a side view of the cover according to the FIG. 1.
Figure 3:
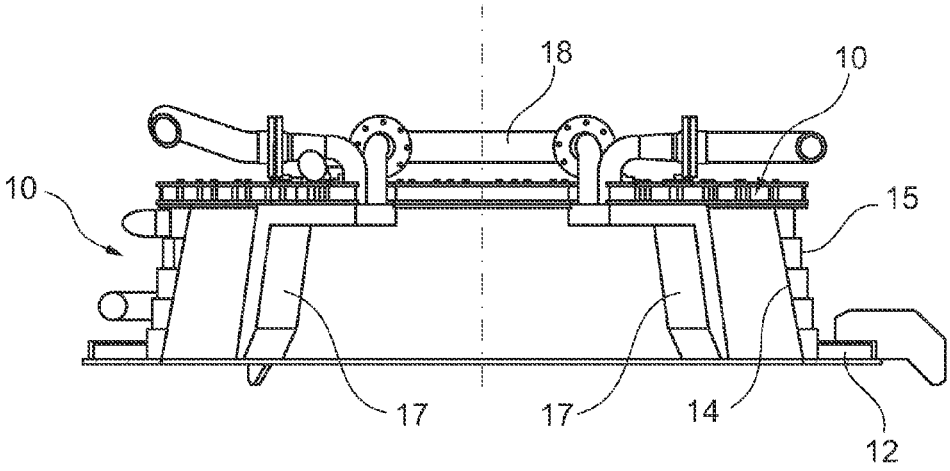
FIG. 3 and FIG. 4 show a view of the cover in the direction of the planes III-III and IV-IV, respectively, of FIG. 1.
Figure 4:
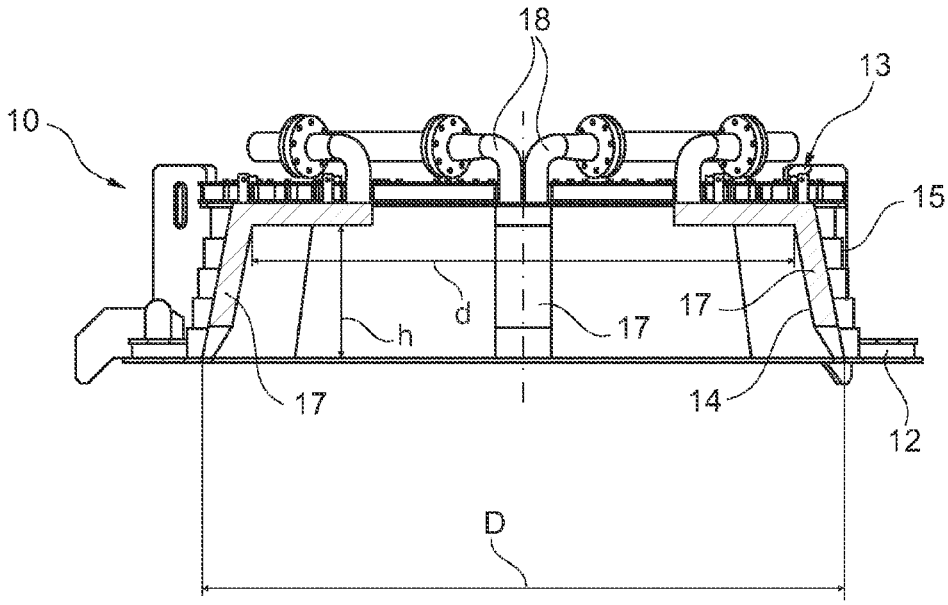

The figures illustrate a cover 10 according to the invention in the form of a welded steel construction. The cover 10 serves for covering a treatment vessel 1 which is merely indicated and in which molten metal with or without additives as well as slag is contained. The treatment vessel 1 preferably has a (non-illustrated) refractory lining.

The cover 10 has a centrally arranged opening 11 for introducing a blowing or jetting lance. The cover 10 rests with its water-cooled flange 12 on the upper side of the treatment vessel 1.

The cross-section of the cover 10, at least at its inner side, is dome-shaped. As dome-like formation is to be understood that the inner diameter D in the region of the flange 12 is larger than the inner diameter d on the cover's 10 side facing away from the flange 12. According to the invention it is provided that the ratio of the clear height h of the cover 10 to the inner diameter D in the region of the flange 12 is at least 0.2.

The cover 10 has a water-cooled cover sheet 13. Furthermore, cooling channels 15 are shown which are arranged operatively connected with the inner wall 14 of the cover 10 and which are welded from outside onto the inner wall 14. Optionally, it can be provided that on the inner wall 14 additional water-cooled cooling elements 17 are arranged which are preferably made of copper.

The water-cooled flange 12, the cover sheet 13, the cooling channels 15 as well as the cooling elements 17 are connected by means of cooling water lines 18 for cooling water supply and cooling water discharge. The elements of the cooling of the cover 10 are preferably all designed or configured in such a manner that the inner wall 14 has a temperature of maximum 350° C. on the side facing the inner side.

It is also essential that the inner wall 14 is formed at least substantially smooth, that is, without the presence of grooves, gaps and the like.

The inner wall 14 of the cover 10 can consist of steel as well as copper or of steel sheet completely or partially plated with copper. Furthermore, the cover 10 consists of at least two subelements, wherein the flange 12 preferably forms one of the at least subelements.

While specific embodiments of the invention have been shown and described in detail to illustrate the inventive principles, it will be understood that the invention may be embodied otherwise without departing from such principle.

We claim:

1. A water-cooled cover for a treatment vessel for metal melts, wherein the treatment vessel serves for treatment of liquid metal by blowing in solids or gases, or inductive stirring at atmosphere or in vacuum, the cover comprising: a flange; an inner wall facing the metal melt, the cover being dome-shaped, wherein a ratio of inner clear height (h) to inner clear diameter (D) of the flange is at least 0.2, the inner wall being substantially smooth and free of grooves and gaps; and cooling channels arranged on an outer side of the inner wall so that surface temperature of the inner wall is maintained at a temperature of maximum 350° C., wherein the inner wall is made of copper.

2. The cover according to claim 1, wherein the cover has a central opening through which a treatment lance is introducible into a space formed by the inner wall and the treatment vessel.

3. A water-cooled cover for a treatment vessel for metal melts, wherein the treatment vessel serves for treatment of liquid metal by blowing in solids or gases, or inductive stirring at atmosphere or in vacuum, the cover comprising: a flange; an inner wall facing the metal melt, the cover being dome-shaped, wherein a ratio of inner clear height (h) to inner clear diameter (D) of the flange is at least 0.2, the inner wall being substantially smooth and free of grooves and gaps; and cooling channels arranged on an outer side of the inner wall so that surface temperature of the inner wall is maintained at a temperature of maximum 350° C., wherein the inner wall is made of sheet steel at least partially plated with copper.

4. A water-cooled cover for a treatment vessel for metal melts, wherein the treatment vessel serves for treatment of liquid metal by blowing in solids or gases, or inductive stirring at atmosphere or in vacuum, the cover comprising: a flange; an inner wall facing the metal melt, the cover being dome-shaped, wherein a ratio of inner clear height (h) to inner clear diameter (D) of the flange is at least 0.2, the inner wall being substantially smooth and free of grooves and gaps; and cooling channels arranged on an outer side of the inner wall so that surface temperature of the inner wall is maintained at a temperature of maximum 350° C., wherein the inner wall is made of sheet steel, wherein at least one copper cooling element is attached on the inner wall.

* * * * *